United States Patent [19]

Smith

[11] 4,253,413

[45] Mar. 3, 1981

[54] AUTOMATIC SEWING APPARATUS FOR AIR CUSHIONS

[75] Inventor: Stanley E. Smith, Dayton, Ohio

[73] Assignee: General Motors Corporation, Detroit, Mich.

[21] Appl. No.: 60,645

[22] Filed: Jul. 25, 1979

Related U.S. Application Data

[62] Division of Ser. No. 963,432, Nov. 24, 1978.

[51] Int. Cl.[3] ..... D05B 97/00

[52] U.S. Cl. ..... 112/262.3

[58] Field of Search ..... 112/262.3, 262.1, 266.1, 112/121.28, 121.24

[56] References Cited

U.S. PATENT DOCUMENTS

| | | | |
|---|---|---|---|
| 1,482,630 | 2/1924 | Curioni | 112/121.24 |
| 1,595,195 | 8/1926 | Ingram | 112/121.24 |
| 1,788,417 | 1/1931 | Weis | 112/121.24 |
| 1,808,805 | 6/1931 | Bihler | 112/121.24 |
| 1,884,026 | 10/1932 | Lutz | 112/121.24 |
| 2,074,488 | 3/1937 | Prazak | 112/121.24 |
| 2,307,430 | 1/1943 | Thompson | 112/121.24 |

*Primary Examiner*—H. Hampton Hunter
*Attorney, Agent, or Firm*—Edward J. Biskup

[57] ABSTRACT

An automatic sewing apparatus for air cushions that includes a carriage having four circular tables that are sequentially movable to a plurality of circumferentially spaced work stations for receiving a pair of circular sheets of fabric and for sewing the peripheral portion thereof. Each table is combined with a circular cover that pivots into engagement with the sheets of fabric located on the associated table so as to maintain the sheets in position while the peripheral portion is being sewn.

2 Claims, 7 Drawing Figures

AUTOMATIC SEWING APPARATUS FOR AIR CUSHIONS

This is a division, of application Ser. No. 963,432, filed Nov. 24, 1978.

This invention concerns a sewing apparatus and more particularly an automatic sewing apparatus for sewing a pair of circular sheets together to form a restraint cushion.

More specifically, the invention contemplates an apparatus of the above-mentioned type in which a base supports a carriage for rotation about a vertical axis. A plurality of independently rotatable tables are mounted on the carriage and each is movable thereby to a plurality of work stations which are circumferentially spaced about the carriage. A first feeder is positioned at one of the stations for depositing one of a pair of circular sheets on one of the rotatable tables and a second feeder is positioned at a second station for depositing the other of the sheets in overlying concentric relationship with the first sheet. In addition, cover means are mounted on the carriage which are movable into engagement with the overlapping sheets for holding the latter in fixed relative positions on the associated table. A sewing machine is provided at a third station for sewing the outer periphery of the two sheets together and drive means are connected to the carriage for moving each of the tables sequentially from the first station to the second and third stations.

The objects of the present invention are to provide a new and improved sewing apparatus having a plurality of independently rotatable tables which are movable to a plurality of work stations for receiving and maintaining a pair of superimposed sheets of fabric in position so as to allow the sheets to have the outer periphery thereof sewn together; to provide a new and improved sewing apparatus which is combined with fabric feeders that serve to sequentially deposit a pair of circular sheets of fabric on a rotatable table after which the sheets of fabric are maintained in fixed relative positions preparatory to being sewn together; to provide a new and improved sewing apparatus which has a pivoted circular cover that cooperates with a similarly shaped rotatable table for clamping a pair of circular sheets of fabric in fixed relative positions with the peripheral portion of the sheets extending radially outwardly beyond the table so as to allow the sheets to be sewn together; to provide a new and improved sewing apparatus having a circular table that is capable of rotating about a first vertical axis and is also capable of orbiting as a unit about a second vertical axis as it moves to four work stations and sequentially receives a pair of circular sheets of fabric after which the sheets are automatically sewn together along the periphery thereof; and to provide a new and improved sewing system which has a carriage supporting four independently rotatable circular tables that are movable about a vertical axis to a plurality of work stations which are circumferentially spaced about the carriage with each table being combined with a separate circular cover that pivots into engagement with a pair of sheets located on the associated table and thereby holds the sheets in position while the peripheral portion thereof is sewn.

Other objects and advantages of the present invention will be more apparent from the following detailed description when taken with the drawings in which.

Figure 1:
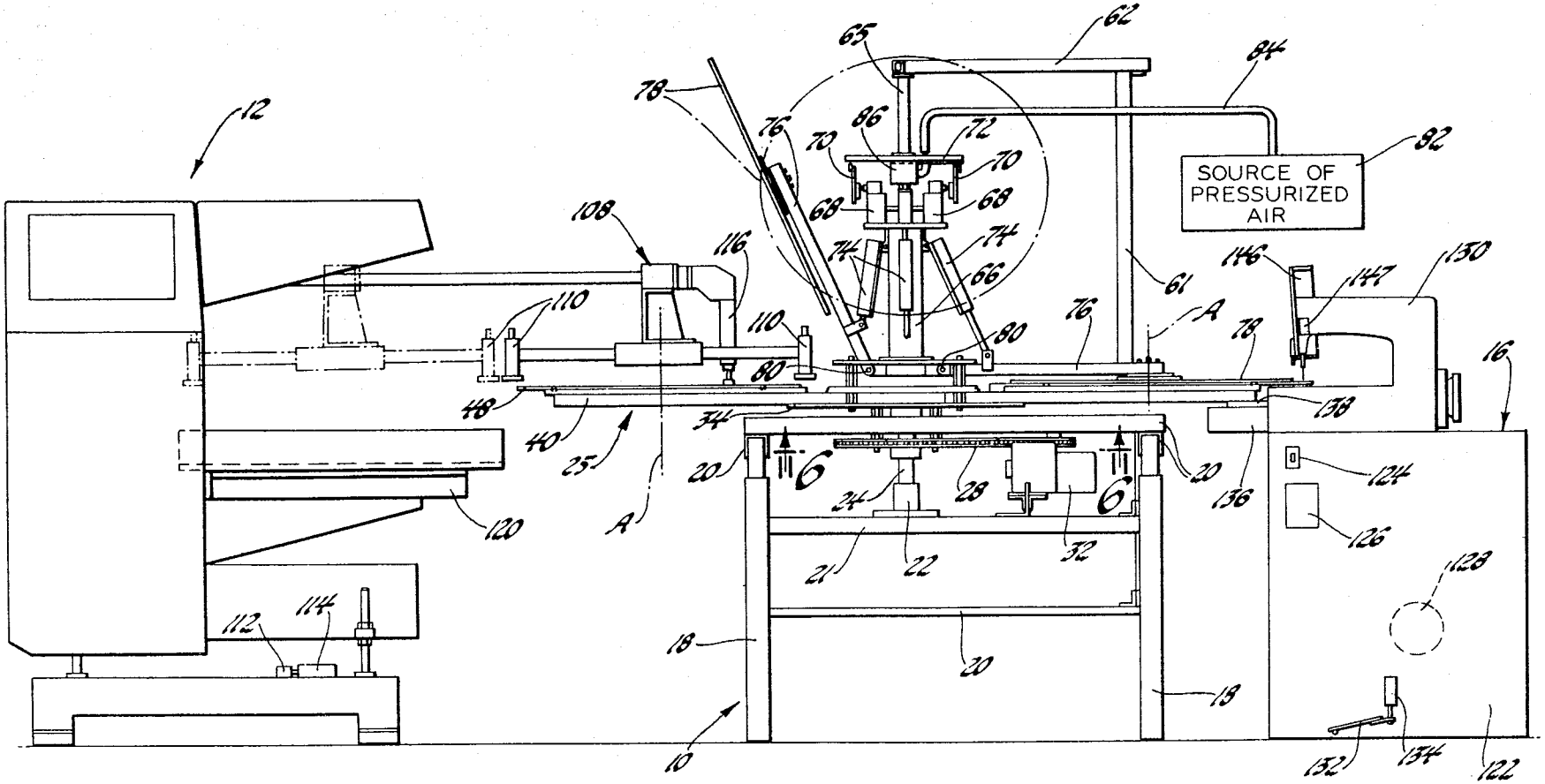
FIG. 1 is a side elevational view showing a sewing apparatus made in accordance with the invention.
Figure 2:
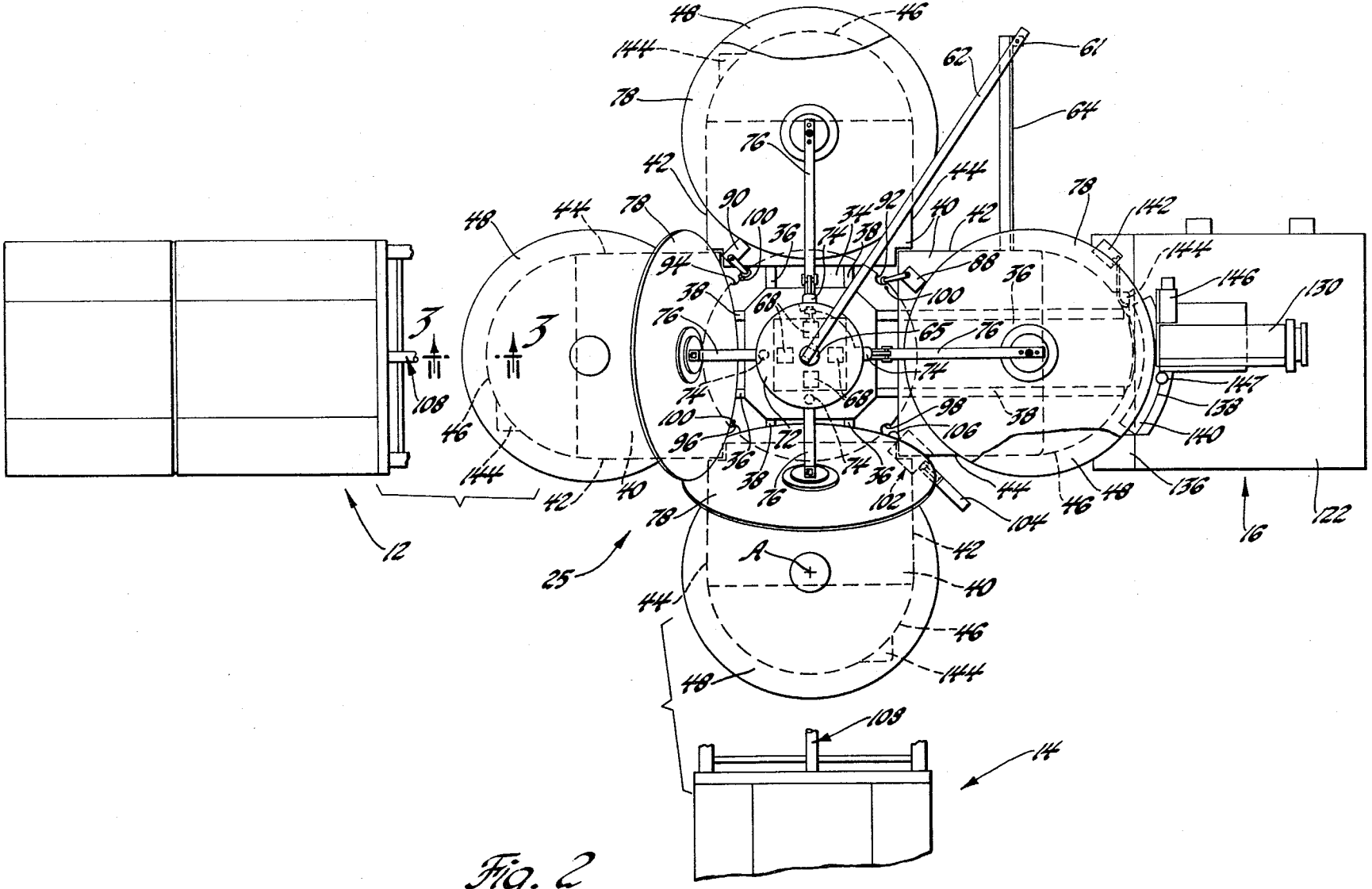
FIG. 2 is a plane view showing the sewing apparatus of FIG. 1.

Referring to the drawings and more specifically FIGS. 1 and 2, the sewing apparatus made in accordance with the invention is shown and comprises a fabric support device 10, a pair of identical fabric feeders 12 and 14, and a sewing machine device 16. As seen in FIG. 2, the fabric feeders 12 and 14 as well as the sewing machine device 16 are circumferentially spaced about the fabric support device 10 with the longitudinal center axis of each of the feeders 12 and 14 and longitudinal center axis of the sewing machine device 16 being displaced from each other by an angle equal to 90°. Thus, as will be more fully understood as the description of the invention proceeds, whenever the fabric support device 10 indexes 90°, a support table is presented to each of the fabric feeders 12 and 14 and the sewing machine device 16 with the latter providing a function which serves to facilitate the sewing of a pair of superimposed circular sheets of fabric. In this connection, it will be noted that after the two sheets of fabric are sewn together at the periphery thereof, they are reversed in position as shown in U.S. Pat. No. 4,178,344 in the names of Stanley E. Smith et al, and dated Dec. 11, 1979, and assigned to the assignee of this invention, and serve to form a restraint cushion that is normally employed with the steering wheel of a vehicle. As mentioned and as seen in the aforesaid patent, the sheets are circular in configuration, with one of the sheets having a circular opening formed in the center thereof through which pressurized gas is received from a gas generator mounted in the steering wheel.

Figure 6:
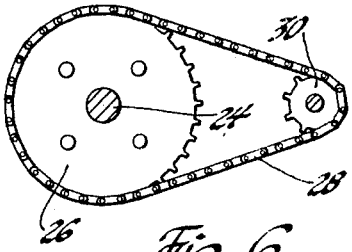
FIG. 6 is a view taken on line 6—6 of FIG. 1.

The fabric support device 10 consists of a base frame formed with four upstanding legs 18 two of which are seen in FIG. 1. The upper ends of the legs 18 are interconnected by a plurality of horizontal channel members such as indicated by the reference numeral 20. The base frame includes a flat platform 21 which has a bearing member 22 supporting the lower end of a drive shaft 24 for rotation about a vertical axis. The drive shaft 24 extends upwardly for connection with a carriage 25, and has an intermediate portion thereof fixed with a sprocket 26 as seen in FIg. 6 which is driven through an endless chain 28 by a sprocket 30. The sprocket 30, in turn, is drivingly connected with the output shaft of an electric motor 32 which is also mounted on the platform 21. Although not shown, a suitable gear reducer is interposed between the output shaft of the motor 32 and the sprocket 30. Thus, by driving the sprocket 30, the carriage 25 is rotated about the vertical center axis of the drive shaft 24.

Figure 3:
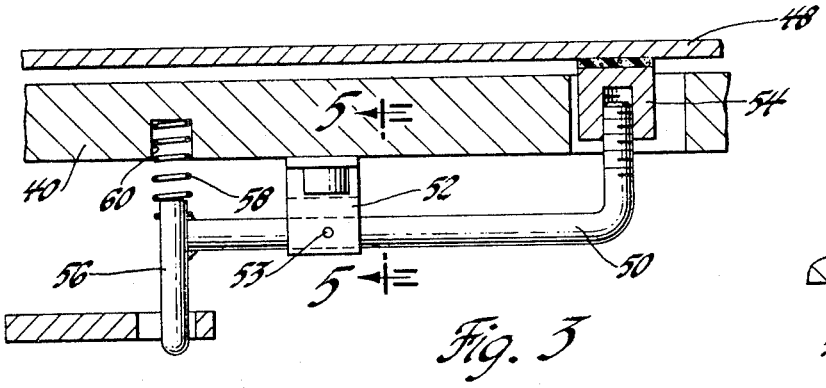
FIG. 3 is an enlarged sectional view of a part of the support carriage and one of the tables connected thereto and is taken on line 3—3 of FIG. 2.
Figure 5:
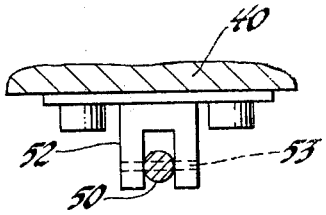
FIG. 5 is a view taken on line 5—5 of FIG. 3.
Figure 4:
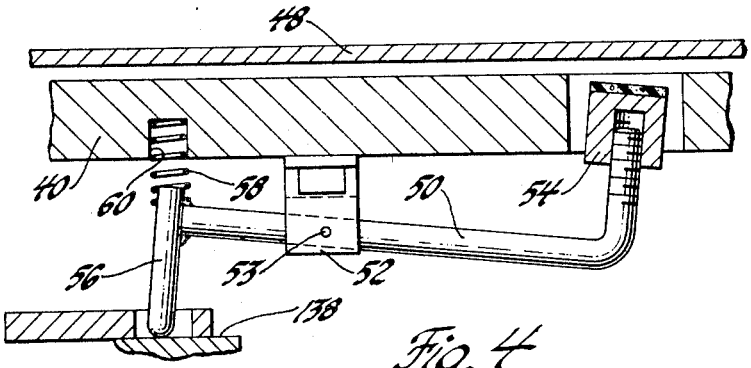
FIG. 4 is a view similar to FIG. 3 with the table being disconnected from the carriage so as to permit the latter to rotate about its support axis.

The carriage 25 comprises a circular support plate 34 which, as seen in FIG. 2, has four pairs of circumferentially spaced parallel arms 36 and 38 rigidly attached thereto and outwardly extending therefrom with the longitudinal center axis of each pair of arms being spaced from the adjacent pair of arms by an angle equal to 90°. Each pair of parallel arms 36 and 38 rigidly support a base plate 40 which extends outwardly with parallel side portions 42 and 44 and terminates with a curved outer surface 46. In addition, each base plate 40 carries a circular table 48 which is supported for rotation about a vertical axis "A" passing through the center of the table. As seen in FIGS. 3 through 5, each base plate 40 is also provided with a brake to prevent rotation of the associated table 48. The brake consists of a lever 50 that is pivoted to a bracket 52 by a pivotal connection 53 and has one end formed with a shoe 54 covered with a resilient material. The other end of the lever 50 is rigidly formed with a vertically extending foot 56, one end of which is engaged by a coil spring 58 located in a bore 60 formed in the base plate 40. The table 48 is normally prevented from rotating relative to the base plate 40 by the shoe 54 except when the lever 50 is moved to the FIG. 4 position at which time the shoe 54 is removed from engagement with the underside of the table 48 and allows the latter to rotate freely about its support axis. Such movement occurs in a manner which will be explained hereinafter.

As seen in FIG. 1, the base frame of the fabric support device 10 includes an "L" shaped support comprising a vertical portion 61 rigidly connected with a horizontal portion 62 which terminates at a point in vertical alignment with the center axis of the drive shaft 24. The vertical portion 61 is fixed with an angle iron 64 that extends horizontally from and is secured to a leg 18 of the base frame, while the horizontal portion rigidly supports a depending pole 65 which is aligned with the center of the carriage 25. As also seen in FIG. 1, a tubular member 66 has its lower end fixed to the center of the carriage 25 while its upper end supports four identical air valves each of which is identified by reference numeral 68 and has a cam follower 70 that is adapted to engage a cam carried by a fixed horizontal circular plate 72 connected to the lower end of the pole 65. The tubular member 66 also carries four air cylinders each of which is identified by reference numeral 74. The base end of each cylinder 74 is pivotally connected to the tubular member 66 while the piston rod of each cylinder 74 is pivotally connected to an arm 76 which rotatably supports a circular cover 78 at its outer end. The inner end of the arm 76 is pivotally connected to the carriage 25 by a pivotal connection 80 so that upon contraction of the associated air cylinder 74, the cover 78 is maintained in a raised position and when the piston rod end of associated air cylinder 74 is vented, the cover 76 drops by gravity into an overlying concentric position with the table 48. A source 82 of pressurized air is connected by a conduit 84 to a manifold 86 mounted to the plate 72 and the manifold 86 serves to supply the pressurized air to each of the air valves 68 from where the air is selectively directed to the air cylinders 74 under the control of the cam follower 70. An air valve 68 that has been used with a fabric support device 10 such as described above was purchased from Numatics Corporation, of Highland Park, Mich., and was identified as Numatrol Model No. LR3-0201.

The drive motor 32 serves to drive the sprocket 30 so as to index each table 48 of the carriage 25 in a counterclockwise direction an angular distance of 90°, as seen in FIG. 2. The energization and deenergization of the drive motor 32 and the feeders 12 and 14 is controlled by limit switches 88 and 90 which are fixed with the base frame and cooperate with four curved notches 92, 94, 96 and 98 formed in the periphery of the circular plate 34 and also an upstanding pin 100 positioned adjacent each of the latter mentioned notches. In addition, a shot pin 102 is mounted on the base frame which includes an air cylinder 104 for moving a circular stop member 106 into one of the notches 92, 94, 96 and 98 formed in the circular plate 34 upon deenergization of the motor 32 so as to properly position the carriage 25 relative to the fabric feeders 12 and 14 and the sewing machine device 16.

Each of the fabric feeders 12 and 14 is a commercially available machine made by USM and identified as Fabri-Feed UFFM-191, Model A. More specifically, each feeder 12 and 14 includes an axially movable arm 108, the outer end of which includes a plurality of circumferentially spaced vacuum support cups 110 which serve to hold a sheet of fabric to the arm 108. In addition, each fabric feeder 12 and 14 has an off/on switch 112 that is operated through a double acting air cylinder 114 and is controlled by the electric circuit shown in FIG. 7. Thus, under the control of the circuit of FIG. 7, the switch 112 is closed and the arm 108 of fabric feeder 12 automatically moves to the full line position seen in FIG. 1 for depositing a sheet of fabric onto the axially aligned table 48. The outer end of the arm 108 has a holddown cylinder 116 combined therewith which permits a portion of the sheet of fabric to be pressed to the table 48 so as to prevent the sheet from floating sideways when vacuum to the support cups 110 is cut off. In this regard, the hold-down cylinder 116 includes a plunger 118 which upon downward movement of a predetermined amount serves to cut off vacuum to the vacuum cups 110 thereby releasing the sheet of fabric and allowing it to settle on the table 48. Once the fabric is released, the arm returns to the dotted line position after which a tray 120 supporting a stack of sheets of fabric moves upwardly so the arm 108 can pick up another sheet of fabric for delivery to the fabric support device 10 under control of the aforementioned circuit seen in FIG. 7. The fabric feeder 14 operates in a similar manner and serves to deposit a second sheet onto the aligned table 48 in overlying relationship with the first sheet of fabric.

Figure 7:
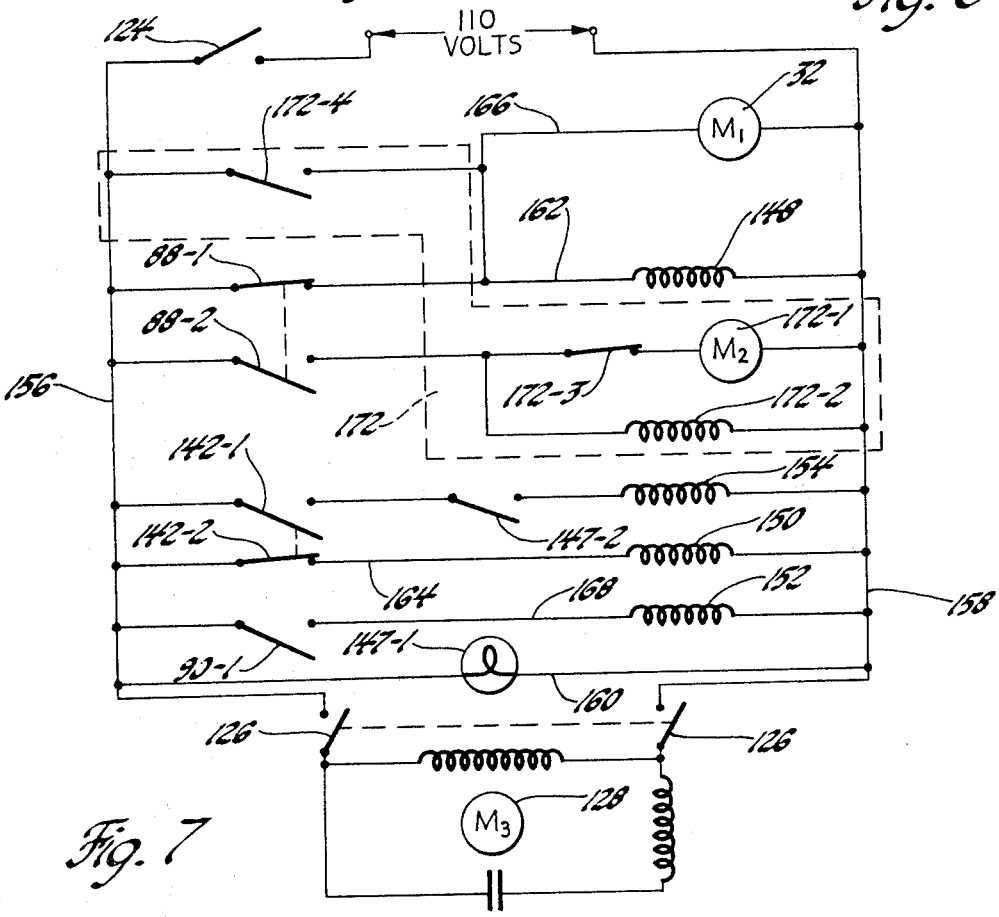
FIG. 7 is a schematic diagram of the electric circuit which controls operation of the sewing apparatus shown in FIGS. 1 through 6.

The sewing machine device 16 includes a support table 122 having an on/off switch 124 for providing electrical power to the circuit of FIG. 7 which controls operation of the fabric support device 10 and the fabric feeders 12 and 14. The support table 122 also has a switch 126 mounted thereon for directing electrical current to the motor 128 of a sewing machine 130 carried by the support table 122. In this case, the sewing machine 130 is a commercially available double needle chain stitch sewing machine made by Union Special Machine Company and is identified as Model 56500. The motor 128 serves to drive the sewing machine needle upon depression of a treadle 132 for providing stitches in the pair of overlying sheets of fabric on the table 48 at a predetermined time as will be explained hereinafter. The sewing machine treadle 132 is operated through a double-acting air cylinder 134.

As seen in FIG. 2, the support table 122 rigidly supports an outwardly extending ledge 136 which supports a curved track 138 which has an upwardly inclined ramp 140 at one end thereof. The track 138 cooperates with the foot 56 of the lever 50 seen in FIGS. 3 and 4 for releasing the shoe 54 from engagement with the underside of the table 48 when the latter moves into a position as seen in FIG. 1 wherein it is in line with the sewing machine device 16. In addition, the ledge 136 supports a limit switch 142 which is actuated by a cam member 144 formed at the outer end of each base plate 40. The limit switch 142 controls operation of a double-acting cylinder which actuates a thread cutting device 146 positioned adjacent to the sewing machine 130 and also controls operation of a photo switch 147 which determines whether or not the pair of overlying sheets of fabric are being held between the cover 78 and table 48 so that the sewing operation can begin. Thus, when the table 48 supports a pair of overlying sheets of fabric, a portion of the sheets extending beyond the edge of the table 48 breaks the light of the photo switch 147 to close the switch.

Before describing the operation of the automatic sewing apparatus, it will be understood that the air cylinders associated with the thread cutting device 146, the sewing machine treadle 132, the fabric feeder switch 114 of each of the fabric feeders 12 and 14, and the shot pin 102 have pressurized air directed to the opposite ends thereof through a spool type valve which is spring biased in one direction and solenoid-operated in the opposite direction. Thus, in the case of the shot pin air cylinder 104, air will normally be directed to the base end thereof so as to cause expansion of the cylinder with the roller type stop member 106 moving into an accommodating notch in the circular plate 34 so as to positively position the carriage 25. Upon energization of the solenoid 148 in the control circuit of FIG. 7, the base end of the cylinder 104 will be connected with atmosphere and the piston rod end will be connected with a source of pressurized air causing contraction of the cylinder 104 with resultant removal of the stop member 106 from engagement with the accommodating notch in the circular plate 34. The thread cutting air cylinder is normally located in the expanded position and it is upon energization of the solenoid 150 in the control circuit that the air cylinder is contracted. In the case of the treadle air cylinder 134 and each of the fabric feeder switch air cylinders 114, these cylinders are normally maintained in the contracted position and are expanded to close the associated switch 112 and depress the treadle 132 upon energization of the solenoids 152 and 154 respectively.

The automatic sewing apparatus described above operates as follows. As seen in FIGS. 1 and 2, it will be assumed that initially air pressure is being fed to the control valves which operate all of the air cylinders associated with this apparatus. In addition, as seen in FIGS. 1 and 7, switches 124 and 126 are in the off position. Also it will be assumed that the carriage 25 is between the set position of FIG. 2, i.e., with the tables 48 offset counterclockwise from the aligned position with the longitudinal axes of the associated fabric feeders 12 and 14 and the sewing machine device 16. At this time, the operator closes switch 124 and also switch 126. This causes the sewing machine motor 128 to be energized through conductors 156 and 158, and the light source 147-1 of photo switch 147 is energized through conductors 156, 160 and 158. In addition, normally closed contacts 88-1 of limit switch 88 permits the shot pin solenoid 148 to be energized through conductors 156, 162, 158 so as to cause the associated spool valve to direct pressurized air to the piston rod end of the air cylinder 104 and place the shot pin in a retracted condition. Normally closed contacts 142-2 of limit switch 142 cause energization of the thread cutting solenoid 150 through conductors 156, 164, 158 so that the air cylinder of thread cutting device 146 is expanded with the blade associated therewith moving downwardly into a cutting position. The drive motor 32 is also energized through contacts 88-1 of normally closed limit switch 88 which allows current to flow through conductors 156, 162, 166 and 158. As seen in FIG. 2, this then causes counterclockwise rotation of the carriage 25 until the pin cam 100 mounted on the circular plate 34 adjacent notch 92 closes contacts 90-1 of normally open limit switch 90. At this point, solenoid 152 is energized through conductors 156, 168 and 158 causing pressurized air being directed to the base end of the air cylinder 114 to expand the latter and close the switch 112 which starts the work cycle of each fabric feeder 12 and 14. At this point, the feeder arm 108 of fabric feeder 12 is connected with vacuum and through the vacuum cups 110 grips one sheet of fabric from tray 120 and moves forwardly for depositing the sheet of fabric onto the associated table 48. The other fabric feeder 14 goes through a similar work cycle and provides the second sheet of fabric onto the associated work table 48. It will be noted that the covers 78 associated with the tables 48 receiving the sheets of fabric are maintained in a raised position at this time through the air valves 68 mounted on the tubular member 66. The cover 78 associated with the table 48 in line with the sewing machine device 16 is in the lowered position.

As the carriage 25 moves to the set or full line position of FIG. 2, the cam member 144 on the base plate 40 engages limit switch 142 mounted on the ledge 136. As a result, contacts 142-1 are closed and contacts 142-2 are opened causing the thread cutting solenoid 150 to be deenergized so that the thread cutting air cylinder is contracted. If the light source 147-1 of photo switch 147 is blocked by the peripheral portion of the sheets of fabric on the table 48 aligned with the sewing machine device 16, the contacts 147-2 are closed and the treadle solenoid 154 is energized causing pressurized air to be directed to the sewing air cylinder 134 to expand the latter and thereby engage the sewing machine clutch.

About the time that limit switch 90 is tripped by the pin cam 100 to close contacts 90-1, the roller of limit switch 88 moves into notch 98 formed in the circular plate 34. This causes the contacts 88-1 to open and contacts 88-2 to close. Opening of contacts 88-1 causes the shot pin solenoid 148 to be deenergized resulting in the base end of the air cylinder 104 being pressurized so as to cause it to expand and move the stop member 106 into the accommodating notch 96 in the circular plate 34 and thereby precisely position the carriage 25 and accordingly the tables 48 relative to the fabric feeders 12 and 14 and the sewing machine device 16. At the same time, the drive motor 32 is deenergized due to the opening of contacts 88-1 and a timer 172 is energized. As to the latter, the timer motor 171-1 and the timer clutch solenoid 172-2 are energized through the closed contacts 88-2. During this time, assuming a pair of sheets are on the table 48 positioned in alignment with the sewing machine device 16, the sewing machine 130 begins sewing the peripheral edge of the two sheets. Inasmuch as the table 48 positioned at the sewing machine device is released from fixed engagement with the associated base plate 40 as the latter moves over track 138 as hereinbefore explained, the sewing of the sewing machine 130 causes the table 48 and cover 78 to freely rotate about axis A for a predetermined time. This time is controlled by the timer 172 incorporated in the control circuit of FIG. 1. A timer that can be used in a circuit as shown is a 1–10 second timer manufactured by Bliss-Eagle-Signal, and identified as Cycle Flex Model HP-515 A616. Assuming the sewing machine 130 causes the outer seam to be sewn in approximately 9 seconds, the timer motor will cause the carriage 25 to maintain the set position shown in FIG. 2 for the 9 second time interval while the sewing machine is operating. When the timer runs out, the timer contacts 172-3 are opened stopping the timer motor 172-1. Timer contacts 172-4 are simultaneously closed thereby energizing the drive motor 32 and at the same time energizing the shot pin solenoid 148 so as to contract the air cylinder 104 and remove the stop member 106 from notch 96. This causes the carriage 25 to be rotated counterclockwise with the result that the roller of limit switch 88 moves out of the accommodating groove 98 so as to close contacts 88-1 and open contacts 88-2 permitting the timer clutch solenoid 172-2 to be deenergized for resetting the timer. The rotation of the carriage 25 also causes limit switch 142 to move off the cam 144 resulting in the contacts 142-1 being opened and contacts 142-2 being closed. As a result, the sewing machine treadle solenoid 154 is deenergized to stop the sewing action and at the same time solenoid 150 is energized so the thread cutter is activated to cut the thread. At this point, a new cycle begins as aforedescribed.

It will be noted that as seen in FIG. 2, after the sewing operation is completed by the sewing machine 130, the table 48 having the sewn sheets of fabric moves counterclockwise to the next position and the cam on circular plate 72 causes the appropriate air valve 68 to be opened to direct pressurized air to the piston rod end of the associated air cylinder 74. As a result, the associated cover 78 is raised and the completed sheets of fabric can be removed from the table.

Various changes and modifications can be made in this construction without departing from the spirit of the invention. Such changes and modifications are contemplated by the inventor and he does not wish to be limited except by the scope of the appended claims.

The embodiments of the invention in which an exclusive property or privilege is claimed are defined as follows:

1. A method of sewing a pair of equal diameter circular sheets of fabric together to form a restraint cushion for a vehicle, comprising the steps of placing one of said pair of sheets on a rotatable circular table having a diameter less than the diameter of said sheets so that the peripheral portion of said sheets extends uniformly beyond the circumferential edge of said table, placing the other of said pair of sheets onto said one of said sheets in concentric relationship therewith, moving a cover onto said pair of sheets so as to maintain the latter in a fixed position on said table while applying a restraining force to said table to prevent the latter from rotating, positioning the table adjacent a sewing machine and simultaneously releasing said restraining force so as to allow said table to freely rotate as the peripheral portion of said sheets is sewn together by said sewing machine.

2. A method of automatically sewing a pair of circular sheets of fabric together with a sewing machine to form a restraint cushion using a carriage supported for rotation about a vertical axis and having a plurality of circular tables mounted on the carriage for independent rotation, said method comprising the steps of depositing one of said pair of circular sheets on one of said circular tables so that the peripheral portion of said one of said circular sheets extends uniformly beyond the circumferential edge of said one of said circular tables, applying a restraining force to said one of said circular tables to prevent rotation thereof, moving said one of said circular tables to a first position spaced from said sewing machine and depositing the other of said sheets in concentric relationship with said one of said sheets, positioning a cover onto said pair of sheets so as to maintain said pair of circular sheets in a fixed position on said one of said circular tables, and moving said one of said circular tables to a second position adjacent said sewing machine while simultaneously releasing said restraining force so as to allow said one of said circular tables to freely rotate as said peripheral portion of said pair of circular sheets is sewn together by said sewing machine.

* * * * *